US009039436B2

(12) United States Patent
Tiberghien et al.

(10) Patent No.: US 9,039,436 B2
(45) Date of Patent: May 26, 2015

(54) ELECTRICAL CONNECTOR WITH AUTOMATIC ENGAGEMENT

(71) Applicant: STAUBLI FAVERGES, Faverges (FR)

(72) Inventors: Alain-Christophe Tiberghien, Sevrier (FR); Christophe Durieux, Gilly sur Isere (FR); Serafim Marques Barroca, Frontenex (FR)

(73) Assignee: STAUBLI FAVERGES, Faverges (FR)

( * ) Notice: Subject to any disclaimer, the term of this patent is extended or adjusted under 35 U.S.C. 154(b) by 0 days.

(21) Appl. No.: 14/137,128

(22) Filed: Dec. 20, 2013

(65) Prior Publication Data

US 2014/0187073 A1 Jul. 3, 2014

(30) Foreign Application Priority Data

Jan. 2, 2013 (FR) ..... 13 50017

(51) Int. Cl.

| | |
|---|---|
| ***H01R 13/62*** | (2006.01) |
| ***H01R 13/625*** | (2006.01) |
| ***H01R 13/52*** | (2006.01) |
| ***H01R 13/639*** | (2006.01) |
| ***H01R 13/641*** | (2006.01) |

(Continued)

(52) U.S. Cl.

CPC ..... *H01R 13/625* (2013.01); *H01R 2103/00* (2013.01); *H01R 13/5219* (2013.01); *H01R 13/639* (2013.01); *H01R 13/641* (2013.01); *H01R 24/22* (2013.01); *H01R 24/30* (2013.01)

(58) Field of Classification Search

CPC .... H01R 13/625; H01R 13/639; H01R 13/53; H01R 13/646

USPC ..... 439/311

See application file for complete search history.

(56) References Cited

U.S. PATENT DOCUMENTS

| | | | |
|---|---|---|---|
| 3,727,172 | A | 4/1973 | Clark |
| 5,685,730 | A | 11/1997 | Cameron |

(Continued)

FOREIGN PATENT DOCUMENTS

| | | | |
|---|---|---|---|
| DE | 102005038167 | A1 | 2/2007 |
| EP | 1862719 | A1 | 12/2007 |

(Continued)

*Primary Examiner* — Jean F Duverne

(74) *Attorney, Agent, or Firm* — Dowell & Dowell, PC

(57) ABSTRACT

This electrical connector (R) comprises a first connection element (100) and a second connection element (200). The two connection elements (100, 200) are able to be coupled to one another according to a coupling axis and comprise at least one pin and at least one respective contact, a locking mechanism (104, 218) comprising at least one locking pin (104) arranged on a body of the first connection element (100) and at least one locking ring (216) mounted rotatingly around a body of the second connection element (200) and comprising a locking groove (218) with an outlet (236) and a locking notch (238), means for indexing making it possible to position the bodies in relation to one another around the coupling axis in an indexed configuration. The second connection element (200) comprises a safety ring (220) mounted axially mobile in relation to the locking ring (216) and comprising at least one safety catch (234). In addition, the safety ring (220) is able to be pushed back by the locking pin (104) during coupling between, a first position, wherein the safety catch (234) blocks the passage of the pin towards the outlet (236), and a second position, wherein the safety catch (234) authorises the passage of the pin, with the safety ring (220) being drawn back elastically to its first position. In addition, each locking groove (218) comprises at the front, a chamfer delimiting the outlet and the rotation range of the locking ring is limited. Finally, in the indexed configuration of the bodies, the axis of travel (X4-X4) of the pin (104) intersects the outlet (238) over the entire the rotation range of the locking ring.

15 Claims, 10 Drawing Sheets

(51) Int. Cl.

| | |
|---|---|
| *H01R 103/00* | (2006.01) |
| *H01R 24/22* | (2011.01) |
| *H01R 24/30* | (2011.01) |

(56) References Cited

U.S. PATENT DOCUMENTS

| | | | | |
|---|---|---|---|---|
| 6,626,699 | B1 * | 9/2003 | Epe et al. | 439/527 |
| 7,824,204 | B2 * | 11/2010 | Fujiwara et al. | 439/320 |
| 2005/0239311 | A1 * | 10/2005 | Yokoigawa et al. | 439/311 |
| 2007/0274772 | A1 | 11/2007 | Tiberghien et al. | |
| 2008/0200076 | A1 | 8/2008 | Natter et al. | |
| 2014/0295690 | A1 * | 10/2014 | Quero pacheco et al. | 439/271 |

FOREIGN PATENT DOCUMENTS

| | | | |
|---|---|---|---|
| FR | 2147289 | A2 | 3/1973 |
| GB | 2356496 | A | 5/2001 |

* cited by examiner

ELECTRICAL CONNECTOR WITH AUTOMATIC ENGAGEMENT

The invention relates to an electrical connector comprising a first connection element and a second connection element complementary to the first, the two connection elements being able to be coupled to one another. In particular, it can be considered that the first connection element is a male element and the second connection element is a female element, with the understanding that the inverse can be considered. By way of example, the invention has for application a power connector with multiple-contact pins and sockets with earthing pin and a power circuit.

It is known in FR-A-2 147 289, that an electrical connector can comprise an indexing device, making it possible to direct the male element in relation to the female element around the coupling axis. It is also known from this document that a connector can comprise a locking mechanism, making it possible to prevent the uncoupling of the connector, as long as this mechanism has not been deactivated. In this case, the locking mechanism comprises a locking pin that progresses in a locking groove located curvilinearly inside a rotating ring. A locking spring cooperates with a first housing located inside the ring in order to maintain the ring in locking position of the pin when the connector is coupled and in uncoupled configuration, the locking spring cooperates with a second housing in order to, after indexing, position the locking pin facing the entrance of the locking groove, as such facilitating the locking of the connector. As such, the angular travel between the two housings corresponds to the travel carried out by the locking pin in order to reach the end of the locking groove. However, if the ring is turned after disconnection before the next connection, the spring is out of its second housing and the operator must manually rotate the ring in order to allow for the engagement of the pin in the locking groove. In addition, using a spring to maintain the ring fixed in rotation and therefore to maintain the connector in coupled position lacks in reliability as the resistance of the spring is not enough to counteract a misplaced gesture of an operator. Moreover, in the case where an electrical connector would be connected to a machine on an assembly line, this machine being able to move, it is possible that one of the elements of the connector moves away in an untimely manner. Nothing is provided for this purpose to automatically disconnect the two connection elements and as such prevent a deterioration of the latter.

It is also known, in reference to FR-A-1 307 976 that in power connectors, the earth should be connected first, then the power circuit and finally, possibly a pilot circuit associated with relays. Logically, the reverse sequence occurs in the direction of the uncoupling. This makes it possible to guarantee a secure connection and disconnection of the power circuit as the latter is then not supplied with current. However, in the case where the operator starts to couple such a connector provided with a bayonet-type locking until the pilot pin reaches the pilot contact, as such closing the pilot circuit and stops all coupling forces, the locking pin may not have reached the locking position. In this configuration, there is then a risk of current passing into the power circuit, although the two connection elements are not completely coupled, and this can result in a brutal uncoupling.

It is these disadvantages that the invention intends to overcome more particularly by proposing an electrical connector comprising a locking device that is more reliable and more ergonomic and improved connection safety.

To this effect, the invention relates to an electrical connector comprising a first connection element and a second connection element, complementary to the first connection element, the two connection elements being able to be coupled to one another according to a coupling axis, with the first and the second connection element comprising at least one pin carried by the first element or the second element and at least one respective contact carried by the second element or the first element, a mechanism for bayonet-type locking of the connector comprising at least one locking pin arranged on a body of the first connection element and at least one locking ring mounted rotatingly around a body of the second connection element and comprising a locking groove with an outlet and a locking notch wherein the locking pin is able to be locked axially in relation to the body of the second connection element, means for indexing making it possible to position the body of the first element and the body of the second connection element, one in relation to the other around the coupling axis in an indexed configuration which intervenes, during coupling, before the engagement of the locking pin in the locking groove. In accordance with the invention, the second connection element comprises a safety ring mounted mobile in axial translation in relation to the locking ring, and comprising at least one safety catch, the safety ring able to be pushed back by the locking pin during coupling between, a first position wherein the safety catch blocks the passage of the pin between the locking notch and the outlet, and a second position wherein the safety catch authorises the passage of the pin, the safety ring being drawn back elastically to its first position, each locking groove comprising at the front, a chamfer delimiting the outlet. In addition the rotation range of the locking ring in relation to the body of the second connection element around the coupling axis is limited. In the indexed configuration of the bodies of the first and second elements, the axis of travel of the pin intersects the outlet of the locking groove over the entire rotation range of the locking ring.

Thanks to the invention, the locking pin once indexed, automatically engages in the locking groove solely under the axial fitting forces and this in a reliable manner since there is no spring to position the locking ring in rotation.

According to advantageous but not mandatory aspects of the invention, an electrical connector can incorporate one or several of the following characteristics taken in any technically permissible combination:

- The angle of opening of the outlet of the locking groove in a plane perpendicular to the axis is greater than or equal to the rotation range of the locking ring around the body of the second connection element.
- the locking notch is inclined in relation to the coupling axis by moving away from the front of the locking ring and in that the safety catch blocks the locking pin in locked position in the coupled configuration of the connector.
- The first and the second connection elements include, furthermore:
- means for earthing including an earthing pin arranged on an element among the first and the second connection element and an earth contact arranged on the other element, the earthing pin able to engage according to the coupling axis into the earth contact,
- means for connecting a power circuit including at least one power pin arranged on an element among the first and the second connection element and at least one power contact arranged on the other element, with the power pin able to engage, according to the coupling axis, into the power contact.
- means for connecting a pilot circuit including at least one pilot pin arranged on an element among the first and the second connection element and at least one pilot contact arranged on the other element, with the pilot pin able to engage, according to the coupling axis, into the pilot contact.

In the indexed configuration of the two bodies before the engagement of the pin with the locking groove, an axial distance, taken according to an axis parallel to the coupling axis, between each earthing pin and its respective earth contact is less than an axial distance between each power pin and its respective power contact, with the axial distance between each power pin and its respective power contact being less than an axial distance between each pilot pin and its respective pilot contact.

During coupling, the connection to the earth is carried out before the connection of the power circuit, the power connection being carried out before the connection of the pilot circuit.

The first connection element and/or the second connection element further comprises a seal able to cooperate with the body of the second connection element and the body of the first connection element, while the seal seals the inside of the bodies of the first and second elements during coupling after the power circuit has been connected.

The second connection element comprises, a shielding blade arranged on a body among the body of the first connection element and the body of the second connection element and able to cooperate with the other body among the body and the body after the power circuit has been connected.

During the coupling, when the locking pin makes contact with a safety catch of the safety ring arranged in its first position, the connection of the or of each pilot pin into the respective pilot contact is not effective.

When the pin cooperates axially with the safety ring while the safety ring is between its first and its second position, the safety ring is able to automatically push back and without action from the operator, a locking pin towards a position wherein the connection of the or of each pilot pin into the respective pilot contact is not effective The body of the first connection element and/or the body of the second connection element is formed from an external body and from an internal insulating body while the internal insulating body is able to be immobilised in relation to the external body in several configurations angularly offset in relation to a central axis of the connection element.

The first connection element and/or the second connection element further include a mechanical foolproof device, constituted of a bore formed around a pin, with the diameter of the bore being substantially equal to the diameter of a cylindrical finger arranged around the respective contact while, during the coupling, the bore and the insulating finger are offset radially in relation to the coupling axis and the bore and the finger are able to cooperate during the coupling in indexed configuration of the bodies.

The rotation range of the locking ring in relation to the body of the second connection element around the axis, is limited angularly by a blocking member.

The blocking member is a key housed in the body of the second connection element, or respectively in the locking ring, and cooperating on the rotation range with a housing radially aligned with the key and arranged in the locking ring, or respectively in the body of the second connection element.

The second connection element comprises means for fastening the safety ring to a fixed point outside of the connector.

The invention shall be better understood and other advantages of the latter shall appear more clearly when reading the following description of an embodiment of an electrical connector in accordance with its principle, provided solely by way of example and made in reference to the annexed drawings wherein:

FIG. 1 is a longitudinal cross-section of a male element of a connector in accordance with the invention, FIG. 2 is a longitudinal cross-section of a female element of the connector, FIG. 3 is an elevational view of the connector formed of the male and female elements of the figures in an indexed configuration, FIG. 4 is a longitudinal cross-section according to the line IV-IV in FIG. 3, FIG. 5 is a longitudinal broken cross-section of which the upper portion is cut according to an inclined plane, by an angle of 120° around the central axis, of the plane of FIG. 4, FIG. 6 is a longitudinal cross-section of the connector during the connection of the means for earthing, FIG. 7 is a longitudinal cross-section of the connector during the continuation of the coupling movement, showing the contact between a locking pin belonging to the male element and a safety ring belonging to the female element, FIG. 8 is an elevational view of the connector in its coupled configuration, FIG. 9 is a cross-section according to the line IX-IX in FIG. 11.

Figure 1:
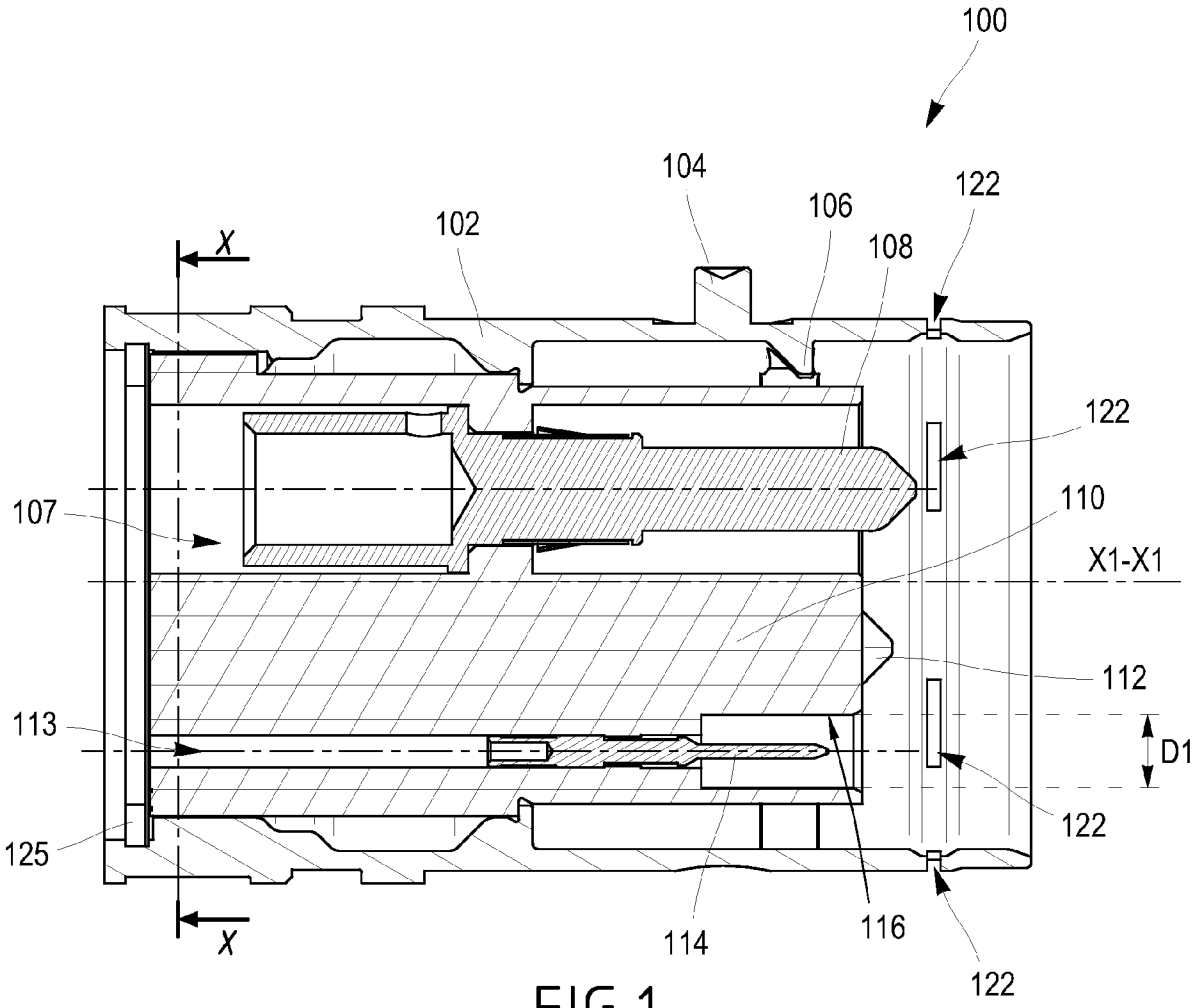

In the figures, pins and contacts can be seen. They are normally connected to conductor cables which are not shown, for the clarity of the drawing.

In the rest of the description, the front direction of a connection element is defined as the direction oriented in the direction of the coupling, i.e. directed towards the complementary connection element. Inversely, the rear direction of a connection element is defined as the direction opposite the complementary connection element.

Figure 3:
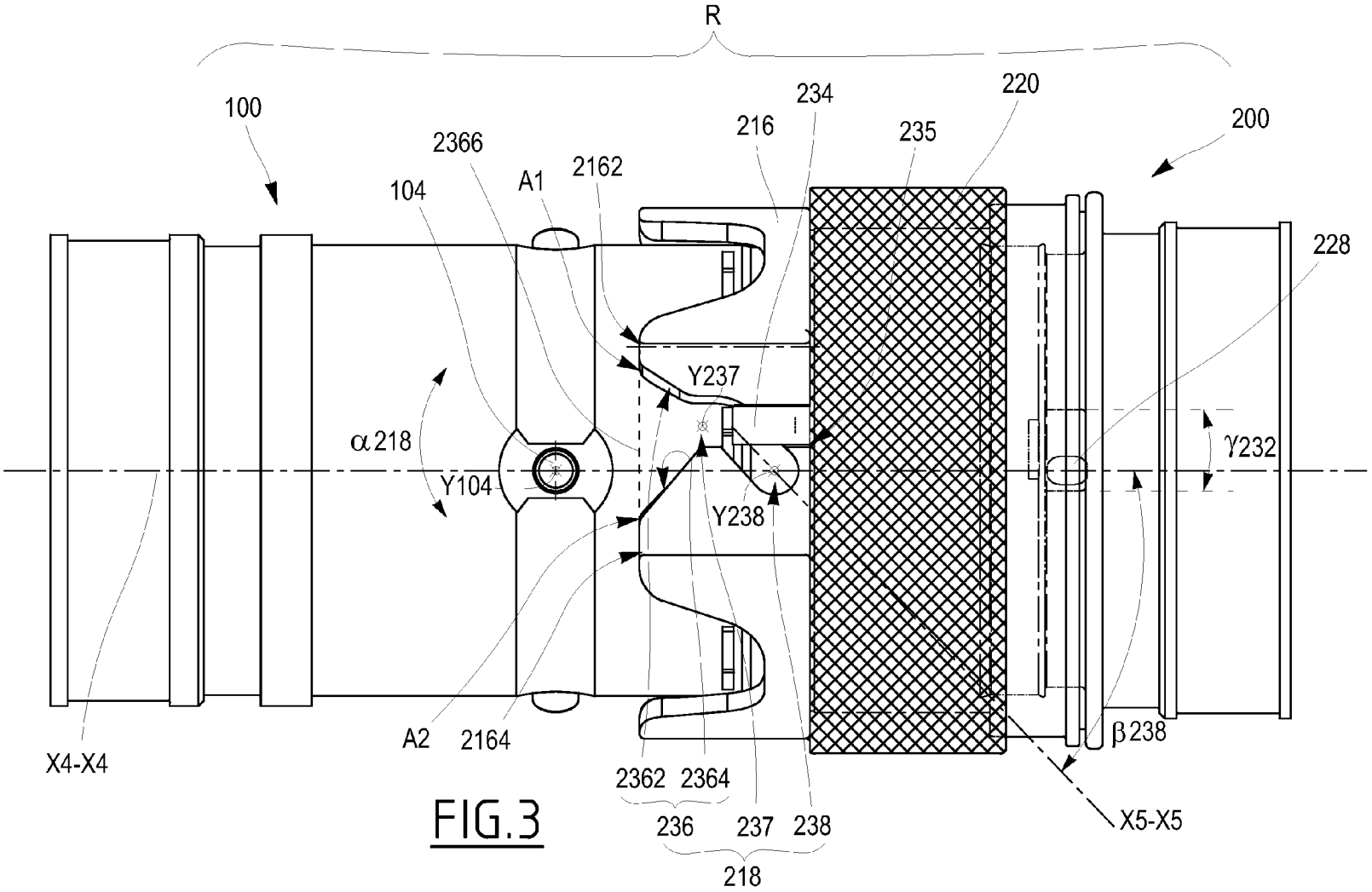
Figure 4:
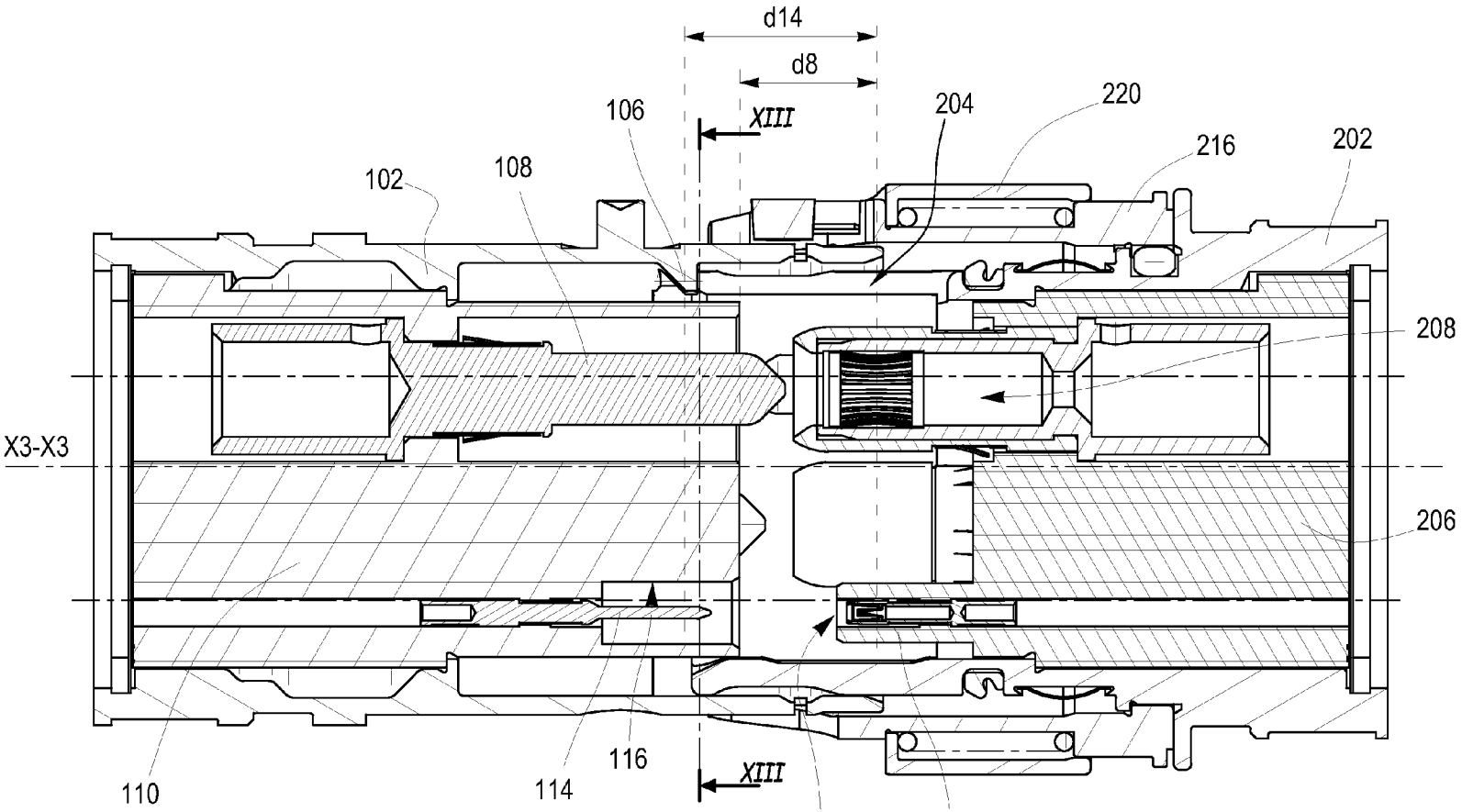
Figure 5:
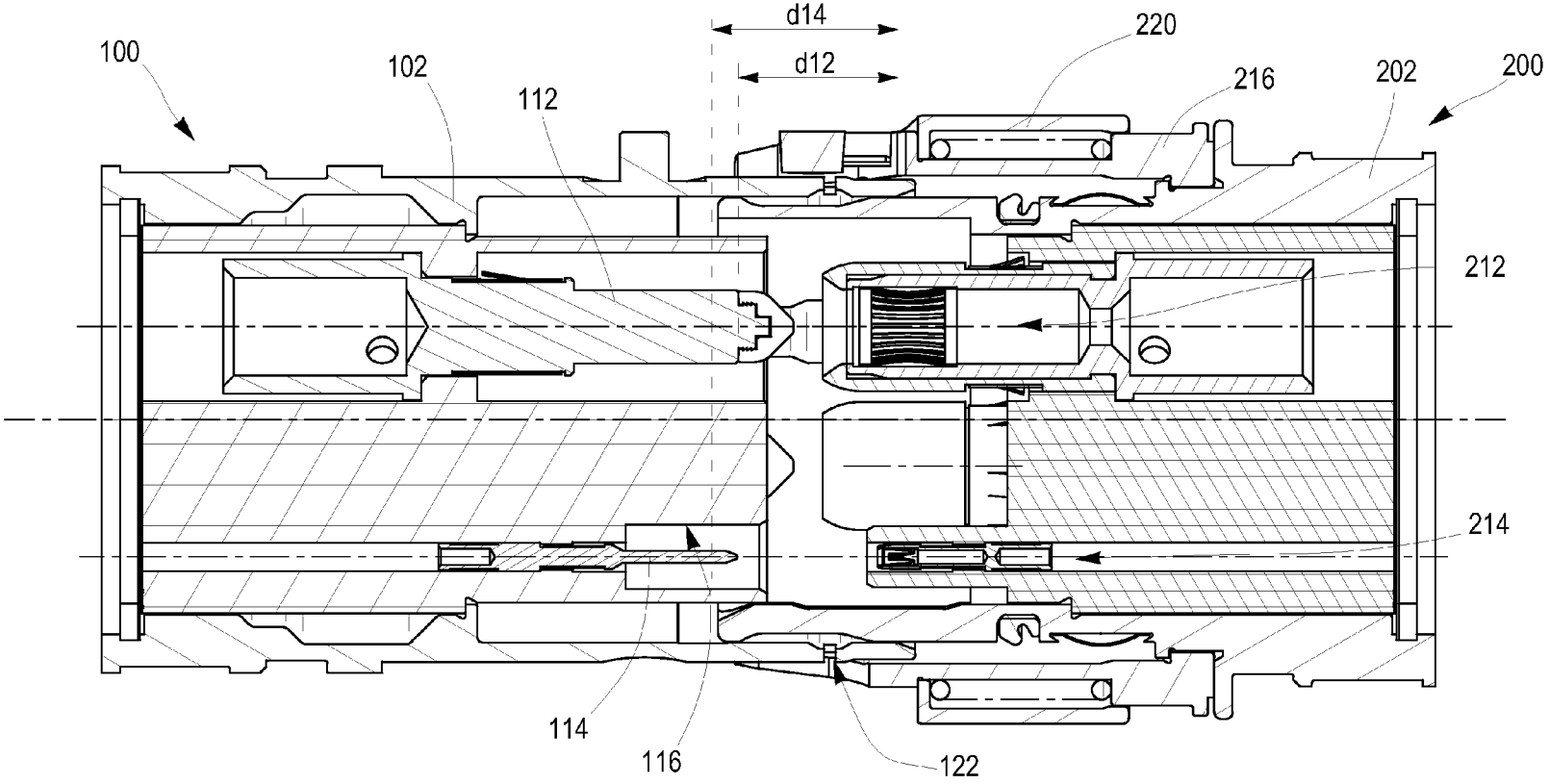

The male element 100 shown in the uncoupled state in FIG. 1 belongs to an electrical connector R which can be seen in FIG. 3 in particular. The element 100 has a generally cylindrical structure centred on an axis X1-X1. This male element 100 comprises an external body 102 whereon are fixedly positioned, radially and directed outwards, three locking pins 104. The three locking pins 104 are arranged angularly in an equally-distributed manner around the axis X1-X1 of the male element 100, i.e. with an angular interval of 120° around the axis X1-X1. More generally, at least one locking pin 104 is required to lock the connector R. The body 102 of the male element 100 further comprises an indexing pin 106 radially arranged inside the body 102 and, at the front in relation to the locking pin 104, i.e. directed towards the female element 200 during the coupling. In addition, the angular orientation of the indexing pin 106 is the same as that for one of the locking pins 104. Y104 denotes the central axis of each pin 104, each axis Y104 being radial in relation to the axis X1-X1.

Inside the external body 102, is arranged a cylindrically-shaped internal insulating body 110, and also centred on the axis X1-X1 and which surrounds an earthing pin 108, two power pins 112 and two pilot pins 114. The earthing pin 108, the two power pins 112 and the two pilot pins 114 all extend parallel to the axis X1-X1. Around at least one pilot pin 114, is arranged a bore 116, of diameter D1, in the insulating body 110. A seal not shown provides the seal between the external body 102 and the insulating body 110. A sealing sheath not shown is installed around the body 102 and cables connected to the pins 108, 112, 114 provides the seal at the rear of the body 102.

The external body 102 further comprises openings 122, arranged at the front of the indexing pin 106, wherein air can flow.

Figure 10:
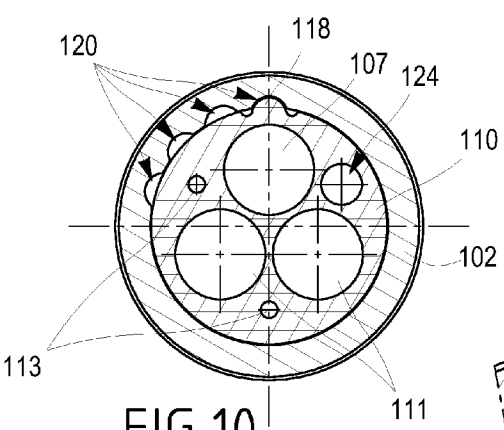
FIG. 10 is a cross-section according to the line X-X in FIG. 1.

As can be seen in FIG. 10, the insulating body 110 comprises on its radial surface an outside longitudinal rib 118 with a shape that is complementary with that of four grooves 120 dug inside and longitudinally, i.e. according to the axis X1-X1, in the body 102 of the male element 100. The rib 118 can be inserted as desired into one of the four grooves 120 and blocked in this position by a retainer 125 or circlip prior to the coupling. This makes it possible to angularly immobilise the insulating body 110 around the axis X1-X1 in relation to the body 102 and to multiply the configurations of the connection element 100 with an identical body and insulator. In this figure, a hole 107 is distinguished wherein is positioned the earthing pin 108, two holes 111 wherein are positioned the power pins 112 and two holes 113 wherein are positioned the pilot pins 114. Also note the presence of another hole 124, which is not used in this embodiment, but wherein it is possible to insert a third pilot pin.

Figure 2:
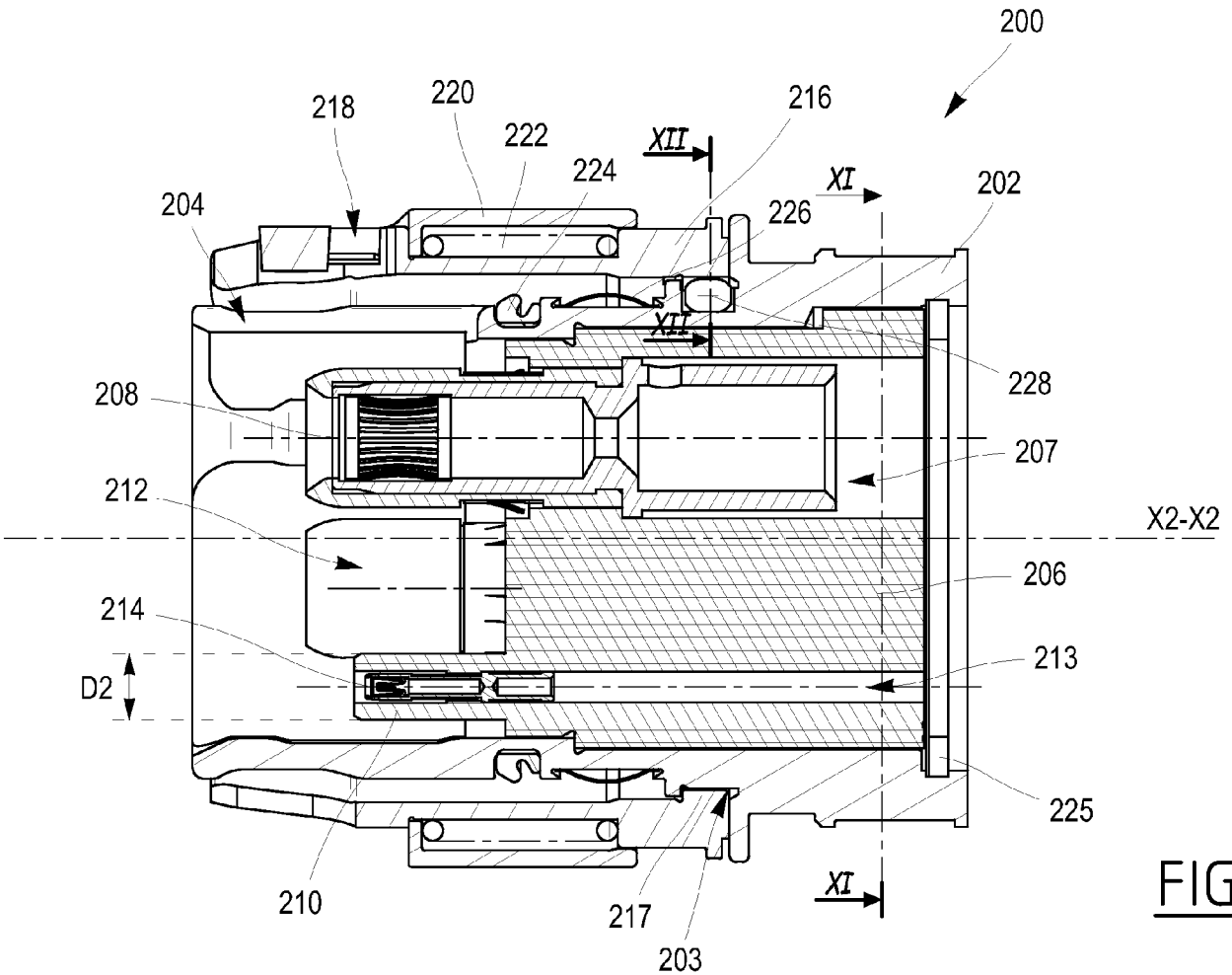

The female element 200 shown in the uncoupled state in FIG. 2 also belongs to the connector R. It also has a generally cylindrical structure centred on an axis X2-X2. The body 202 of the female element 200 comprises a longitudinal indexing groove 204 located at the front of the body 202, i.e. directed towards the male element 100, which has a profile that is complementary with that of the indexing pin 106 of the male element 100 and which extends parallel to the axis X2-X2. In a manner similar to the male element 100, an internal insulating body 206 is arranged inside the body 202 of the female element 200 and encompasses an earth contact 208, two power contacts 212 and two pilot contacts 214, parallel to the axis X2-X2. Around one of the pilot contacts 214, is arranged a cylindrical finger 210 made of insulating material, of which the diameter D2 is substantially equal to the diameter D1 of the bore 116. A seal not shown provides the seal between the body 202 and the insulating body 206. A sealing sheath not shown is installed around the body 202 and cables connected to the contacts 208, 212, 214, and provides the seal at the rear of the body 202.

A locking ring 216 is arranged radially around the body 202. The locking ring 216 is integral in translation according to the axis X2-X2 of the body 202 by the cooperation of a heel 217 of the locking ring 216 with an external groove 203 of the body 202. This locking ring 216 comprises three locking grooves 218 which are located in the front portion of the locking ring 216, i.e. turned towards the male element 100 during the coupling. More generally, the number of locking grooves 218 depends on the number of locking pins 104 and the angular offset around the axis X2-X2 of two locking grooves 218 is the same as the angular offset around the axis X1-X1 of the two respective locking pins 104.

A safety ring 220 is arranged radially around the locking ring 216 and to the rear in relation to the locking grooves 218, i.e. in the direction opposite the male element 100. A means of elastic load, which in the example under consideration is a spring 222, presses longitudinally on the locking ring 216 and on the safety ring 220, as such pushing back the safety ring 220 towards the front in abutment against the locking ring 216 in uncoupled configuration.

A seal 224, of the lip type, is arranged in an external housing of the body 202 and at the rear of the indexing groove 204. A shielding plug 226, which is formed by an elastically deformable metal blade, is arranged at the rear of the seal 224 and housed radially in an external housing of the body 202 of the female element 200.

Figure 12:
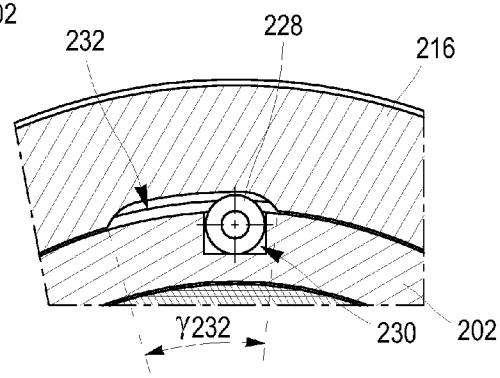
FIG. 12 is a detailed cross-section on a greater scale according to the line XII-XII in FIG. 2.

At the rear of the shielding blade 226, is arranged a blocking member, which in the example under consideration, is a cylindrical key 228 located in a hollow housing 230 opening onto the exterior of the body 202. The key 228 radially extends beyond outwards in relation to the body 202 as shown in FIG. 12. The portion of the key 228 that extends beyond the housing 230 is received in a housing 232 arranged on the internal radial surface of the locking ring 216. This housing 232 extends over an angular sector centred on the axis X2-X2 and of which the angle at the top γ232 is approximately 15°. It is therefore possible to rotate the locking ring 216 in relation to the body 202 around the axis X2-X2 within the limit of an angle of 15° before the protruding portion of the key 228 abuts against one of the longitudinal walls of the housing 232.

Figure 11:
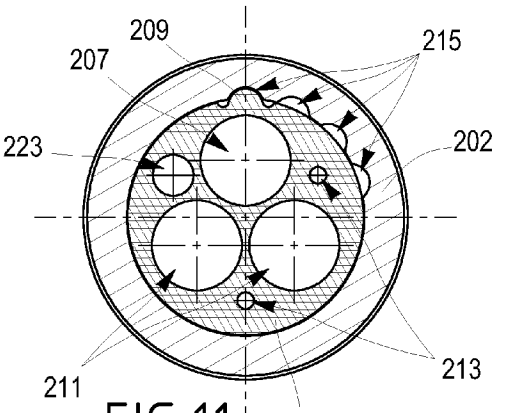
FIG. 11 is a cross-section according to the line XI-XI in FIG. 2.

Similarly to the male element 100 and as can be seen in FIG. 11, the insulating body 206 of the female element 200 is, prior to the coupling, immobilised angularly in the external body 202 in one of the four configurations using a retainer 225. To this effect, the insulating body 206 comprises a longitudinal rib 209 that has a profile that is complementary with that of four grooves 215 provided inside the body 202 of the element 200. In this figure, a hole 207 is distinguished for receiving the earth contact 208, two holes 211 for receiving power contacts 212 and two holes 213 for receiving pilot pins 214. Also note the presence of another hole 223 that can possibly receive a third pilot contact.

The angular immobilisation of the two insulating bodies 110 and 206 in the bodies 102 and 202 impose, in light of the coupling, that the ribs 209 and 118 be aligned after indexing of the two bodies 102 and 202 i.e. that the angular orientation of the insulating body 206 with the body 202 of the female element 200 be compatible with the angular orientation of the insulating body 110 with the body 102 of the male element 100. In the opposite case, the coupling would be impossible.

The coupling of the elements 100 and 200 shall now be described in reference to one of the locking pins 104, with the stipulation that the three pins 104 move at the same time and interact in the same way with the locking ring 216 and with the safety ring 220.

The operator axially brings closer together the two connection elements 100 and 200 and places the body 102 around the body 202.

In the position of FIGS. 3, 4, 5 and 13 the bodies 102 and 202 are angularly positioned one in relation to the other since the indexing pin 106 is inserted into the indexing groove 204. In this configuration, the axis X1-X1 and the axis X2-X2 are confounded with a coupling axis X3-X3. In addition, in the case where the insulating bodies 110 and 206 are immobilised angularly in a compatible manner, the power pins 112 are aligned axially with the power contacts 212, the pilot pins 114 are aligned with the pilot contacts 214 and the earthing pin 108 is aligned with the earth contact 208. More precisely, the hole 107 for receiving the pin 108 is aligned with the hole 207 for receiving the contact 208, the holes 111 are aligned with the holes 211 for receiving the contacts 112 and the holes 113 are also aligned with the holes 213 for receiving pilot contacts 214. On the other hand, no pin has yet reached its respective contact, which means that the current is not flowing through the power circuit or the pilot circuit and the earthing is not yet effective.

The earthing pin 108 and the earth contact 208 form means of earthing, the power pins 112 form with the power contacts 212 means for connecting the power circuit and the pilot pins 114 form with the pilot contacts 214 means for connecting a pilot circuit. This pilot circuit is associated with relays that make it possible to control the flow of current inside the power circuit. The locking pin 104 and the locking groove 218 arranged in the locking ring 216 form a locking mechanism of the connector: this is referred to as a bayonet-type locking.

The locking groove 218 comprises, at the front, i.e. directed towards the male element 100, a chamfer which becomes wider in the direction of the male element 100 and which is constituted of two surfaces 2362 and 2634 each inclined by an angle of approximately 40° in relation to the axis X2-X2 and in the plane of FIG. 3. The surfaces 2362 and 2364 define an outlet 236 that extends inside the locking groove 218 between the two surfaces 2362 and 2364 and of which the angle of opening α218, measured on the front end of the locking ring 216 and around the axis X2-X2 in a plane parallel to that of FIG. 11, is approximately 23°. More precisely the angle of opening α218 is defined between a first edge A1 of the outlet 236 which is the junction between the surface 2362 and a front external edge 2162 of the locking ring 216, and a second edge A2 of the outlet 236, which is the junction between the surface 2364 and a front external edge 2164 of the locking ring 216.

In the indexed position of FIGS. 3, 4, 5 and 13, the locking pin 104 is located axially facing the locking groove 218. In other words, an axis of travel X4-X4 of the pin 104, parallel to the coupling axis X3-X3 and passing through the central axis Y104 of the pin 104, this axis of travel X4-X4 being fixed in relation to the body 202 in the indexed configuration of the bodies 102 and 202, intersects a circle segment 2366 defined in the outlet 236 around the axis X3-X3 between the first edge A1 and the second edge A2 of the outlet 236. This has for advantage that the continuation of the coupling is accomplished simply by bringing closer together the male element 100 with the female element 200, via translation according to the axis X3-X3.

Moreover, the value of the angle of opening α218 of the outlet 236 is chosen to be greater than the angular range of rotation of the locking ring 216 around the axis X2-X2 in relation to the body 202, with this angular range being defined by the angle γ232 which is 15°. In addition the angular positions of the outlet 236 and of the housing 232 on the locking ring 216, the angular positions of the key 228 and of the indexing groove 204 on the body 202, the angular positions of the locking pin 104 and of the indexing pin 106 on the body 102 as such that, in an indexed configuration of the bodies 102 and 202 and regardless of the position of the locking ring 216 in its angular range of rotation defined by the two extreme angular positions of the locking ring 216 for which the key 228 is in circumferential abutment respectively against one and the other of the longitudinal walls of the housing 232, the axis of travel X4-X4 of the pin 104 intersects the circle segment 2366, in other words the locking pin 104 is still within the outlet 236 of the locking groove 218. In FIG. 3, the showing of the angle α218 and of the angle γ232 is very diagrammatical as these angles in fact can be measured in a plane transversal to the coupling axis X3-X3 and perpendicular to the plane of FIG. 3.

In addition, the locking groove 218 comprises at the rear of the outlet 236, a locking notch 238 which extends according to an inclined direction X5-X5, in relation to the coupling axis X3-X3 and in the plane of FIG. 3, by an angle β238 of approximately 45°. In practice the angle β238 is between 30° and 75°. The transition zone extending axially between the outlet 236 and the locking notch 238 is denoted as 237. Y237 denotes an axis radial to the axis X2-X2 and passing through the centre of the zone 237. Y238 denotes an axis radial in relation to the axis X2-X2 arranged in the locking notch 238, and such that in the locked configuration of the pin 104 in the locking notch 238, the axes Y104 and Y238 are confounded.

In the plane of FIG. 3, the notch 238 moves away from the zone 237 and from the outlet 236 by penetrating into the ring 216, i.e. by moving away from the edges 2162 and 2164. The locking groove 218 is comprised of the chamfered outlet 236, of the inclined notch 238 and of the transition zone 237.

During the continuation of the coupling of the male element 100 and of the female element 200, the locking pin 104 falls into the locking groove 218 and drives, due to the geometry of the locking notch 238, the locking ring 216 in rotation around the axis X3-X3.

Figure 14:
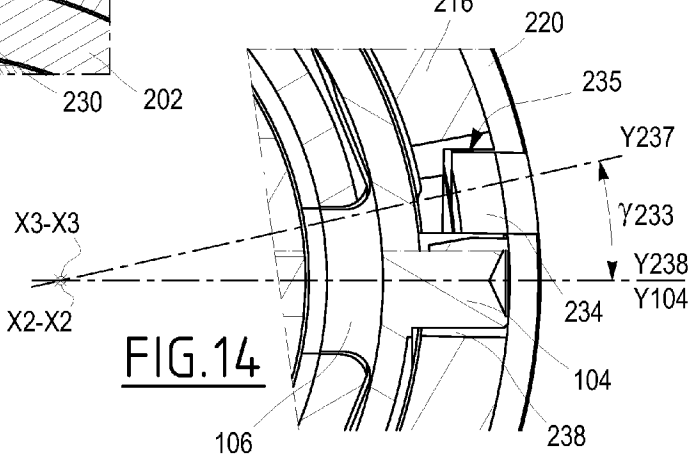
FIG. 14 is a cross-section according to the line XIV-XIV in FIG. 8.
Figure 13:
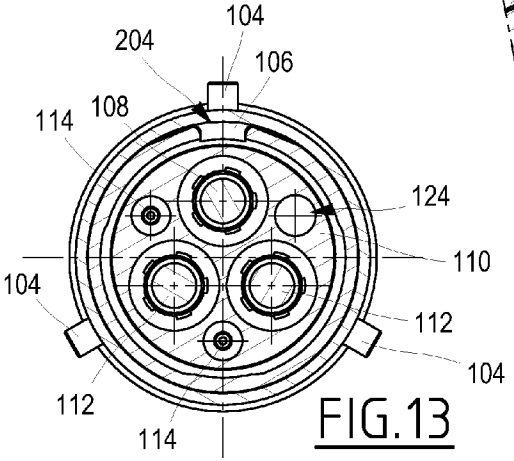
FIG. 13 is a cross-section according to the line XIII-XIII in FIG. 4.

The locking ring 216 is mounted rotatingly around the axis X2-X2 and body 202 of the female element 200, so that the locking pin 104 can engage entirely into the locking notch 238. Indeed, the geometry of the locking groove 218 combined with the fact that the locking pin 104 is fixed in rotation in relation to the body 202 as soon as the bodies 102 and 202 are in indexed configuration, brings the locking ring 216 to rotate around the coupling axis X3-X3 when the locking pin 104 is displaced axially in translation in relation to the locking ring 216 in order to reach its locked position. More precisely, an angle γ233 is defined representing the angular rotation of the ring 216 required so that the locking pin 104 can be engaged from the zone 237 until its locked position in the locking notch 238. The angle γ233 is of a magnitude of 11°. This angle γ233 can be seen better in FIG. 14, it shows the angular separation between the projection of the axis Y237 on a plane perpendicular to the axis X2-X2 and the projection of the axis Y238 on the same plane. When the pin 104 is locked in the locking notch 238, the angle γ233 is equal to the angular separation between the axes Y104 and Y237 projected onto the same plane perpendicular to the axis X3-X3. This angular rotation of angle γ233 is included in the rotation range γ232 of the locking ring 216 which is of a magnitude of 15° in the example. Moreover, the safety ring 220 comprises three safety catches 234, arranged at the front of the safety ring 220, i.e. on the side of the element 100 in the configuration of FIGS. 3 to 5. The front end surfaces of the safety catches 234 are perpendicular to the axis X2-X2. The number of safety catches 234 is equal to the number of locking grooves 218. Each safety catch 234 is guided by an axial groove 235 which can be seen better in FIG. 14. This axial groove 235 is dug in the locking ring 216, and according to the axial extension of the zone 237. As such, the safety ring 220 is mobile in axial translation in relation to the locking ring 216 and integral in rotation with the locking ring 216. The spring 222 pushes back each safety catch 234 into advanced position wherein is blocked the passage for a locking pin 104 between the outlet 236 and the locking notch 238.

In reference to FIGS. 6 to 9, the coming closer together of the two connection elements 100 and 200, according to the coupling axis X3-X3, implies that the locking pin 104 enters into the locking groove 218 and the coupling force can be summarized, if the pin 104 is not aligned with the zone 237, as the pressure of the locking pin 104 on one of the two slopes 2362 and 2364 of the chamfer. This force drives the rotation of the locking ring 216 around the axis X3-X3 which allows it to guide the locking pin 104 in translation to the zone 237 to the extent that the locking pin 104 is located axially facing the front end of the safety catch 234. In parallel to the rotation of the locking ring 216, the electrical connection of the earthing pin 108 with the earth contact 208 is produced and, almost simultaneously, the cylindrical finger 210 surrounding the pilot contact 214 is engaged into the bore 116. This cooperation between the cylindrical finger 210 and the bore 116, which are offset radially in relation to the axis X3-X3, is used as a mechanical foolproof device and prevents the coupling movement from continuing if the orientation of the pins 108, 112 and 114 in the male element 100 is not in accordance with that of the contacts 208, 212 and 214 in the female element 200 as the insulating finger 210 therefore cannot penetrate into the bore 116. This conformity fault can, for example, appear after an incompatibility with the angular positioning of the insulating body 110 with that of the insulating body 206 respectively in relation to the body 102 of the male element 100 and with the body 202 of the female element 200.

Figure 6:
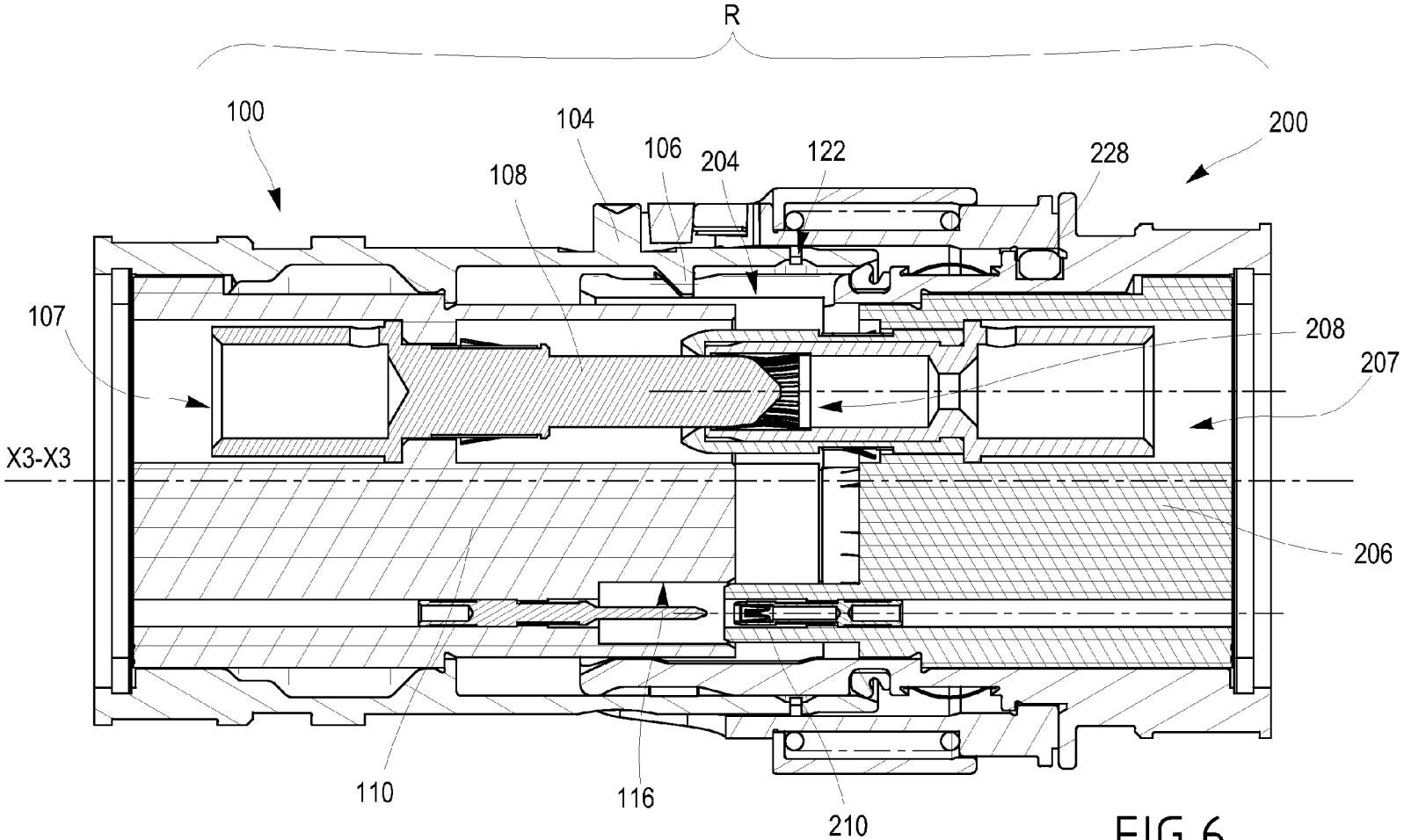

As can be seen in FIG. 6, when the earthing pin 108 is fitted into its contact 208, the connection between the power pins 112 and their respective power contacts 212, is not yet effective. The same applies for the connection between the pilot pins 114 and their respective contacts 214. This is coherent with the fact that the connection of the power circuit is secured since it takes place after the earthing, but before the closing of the pilot circuit.

Figure 7:
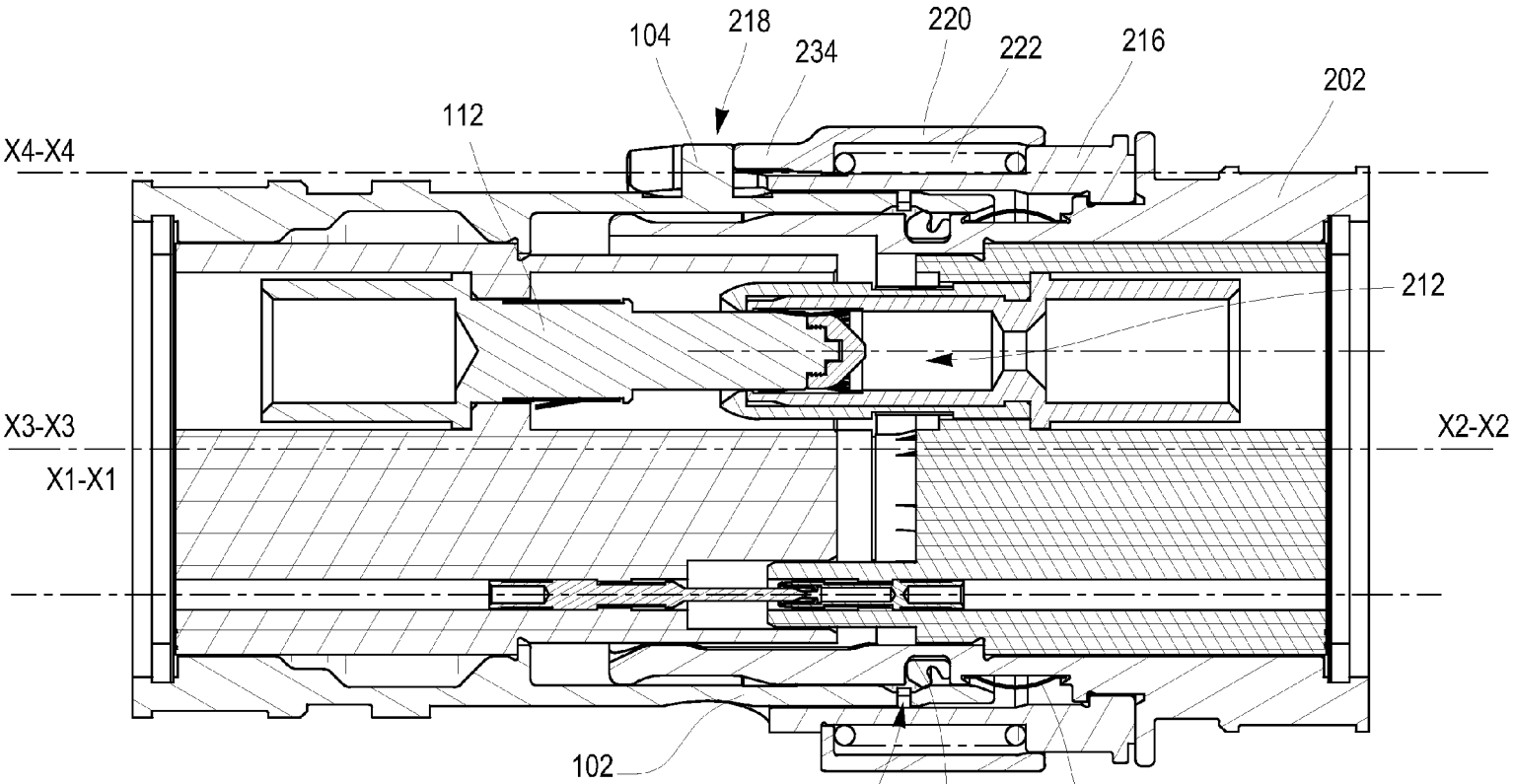

The continuation of the coupling movement brings the connector into the position of FIG. 7. More precisely, the power pins 112 are fitted into their respective contacts 212 as such electrically connecting the power circuit. The body 102 of the male element 100 comes into contact with the lip seal 224, without however sealing the inside of the bodies 102 and 202. Indeed, the openings 122 arranged in the body 102 of the male element 100 are axially located to the front in relation to the seal 224. Air contained between the bodies 102 and 202 can as such be removed to the exterior. Moreover, the locking pin 104, which remains engaged in the locking groove 218, axially reaches contact with the safety catch 234 that it then pushes back axially towards the rear, i.e. opposite the first connection element 100, against the elastic force of the spring 222. This therefore releases the passage towards the locking notch 238 on the zone 237. In this configuration wherein the pin 104 comes into contact with the safety catch 234, the connection between the pilot pins 114 and their respective contacts 214 is not yet effective.

In the last phase of the coupling, the locking pin 104 is engaged into the inclined notch 238 and progresses in the latter. The pilot pins 114 are engaged into their pilot contact 214 while the locking ring 216 continues to rotate around the axis X3-X3 under the axial coupling forces. As soon as the relays associated with the pilot circuit, of which the pins 114 are fitted into the contacts 214, are closed, the current can flow through the power circuit. Note therefore that the electrical connection is secured since in the sequencing order in the connector R, earthing through the engaging of the earthing pin 108 into the earthing contact 208 is effective before the connection of the power circuit by the engagement of the power pins 112 into the power contacts 212 which is itself carried out before the connection of the pilot circuit via engagement of the pilot pins 114 into the pilot contacts 214. In this way, as soon as the earthing is effective, the operator can manipulate the connector without the risk of electrocution, then the power circuit can be connected in complete safety as it is not supplied with current since the electrical connection of the pilot circuit has not yet been established. Finally, the connection of the pilot circuit makes it possible to authorise the circulation of the current through the power circuit.

In order to carry out this connection sequence, the connector is designed in such a way that, during the coupling of the elements 100 and 200, in an indexed configuration of the elements 100 and 200 before the engagement of the pin 104 with the locking groove 218, a distance d8, measured according to an axis parallel to the axis X3-X3, between the earthing pin 108 and its contact 208 is less than a distance d12, measured in parallel to the axis X3-X3, between the power pins 112 and their contacts 212 which is itself less than a distance d14, also taken according to an axis parallel to the axis X3-X3 between the pilot pins 114 and the contacts 214. The distances d8 and d12 can be seen respectively in FIGS. 4 and 5 and the distance d14 can be seen in the two FIGS. 4 and 5. In this way, it is provided that the earthing pin 108 connects first to the earth contact 208, the power pins 112 connect second to the power contacts 212 and the pilot pins 114 connect last to the pilot contacts 214. With the understanding that the reverse sequence occurs during the uncoupling, this makers it possible to provide for the safety of the connection and of the disconnection.

The electrical contacts associated with the pins are provided in a known way by a crown of flexible metal blades deformed by the fitting of the associated pin. At the end of the last sequence of the coupling, the locking pin 104 has reached the locking notch 238 and has radially cleared the safety catch 234; it therefore no longer exerts any axial force on the safety catch 234. As such, the safety ring 220 that is subject to the elastic force of the spring 222 is drawn back elastically, towards the front, as such becoming closer to the first connection element 100. The safety catch 234 comes to partially cover the zone 237 as such blocking the locking pin 104 into the notch 238 in a position wherein the pin 104 is locked axially in relation to the body 202. Indeed the locking pin 104 strikes the safety catch 234 tending to move towards the zone 237. The connector is coupled and any moving away of the bodies 102 and 202 is prevented.

In parallel to the last coupling sequence, the body 102 of the male element 100 continues its movement by compressing the lip seal 224. After the locking pin 104 has come into contact with the safety catch 234, the openings 122 arranged in the body 102 of the male element 100 pass to the rear of the seal 224, the seal is operational between the two bodies and the air contained between the two bodies 102 and 202 is compressed at the end of the coupling. In order to reduce the coupling forces, a lip seal was selected because its compression force is less than that of an O-ring. In addition, this lip seal provides the seal after the power pins 112 have engaged into their contacts 212, with this making it possible to reduce the course of travel over which the air contained between the two bodies 102 and 202 is compressed and as such reduce the coupling forces. Then comes the deformation of the shielding blade 226. During this deformation, the shielding blade 226 is thrust against the body 202 of the female element 200. It as such provides the electrical continuity between the two bodies 102 and 202 for the safety of the operator.

As such, it is possible to guarantee the safety of an operator who would interrupt his force during the coupling. In this case, if the pin 104 has pushed back the safety catch 234 without however reaching locked position, the safety ring 220 and the safety catches 234 are elastically pushed back by the spring 222 towards the front, since the operator is no longer exerting any force to compress the spring 222. The effort exerted by the spring 222 on the pin 104 goes against the friction forces between the connection elements 100 and 200, and in particular the friction forces of the pins 108 and 112 which are respectively already engaged in their contacts 208 and 212. This results in that the locking pins 104 are pushed back by the catches 234 in the direction of the outlet 236 towards a position wherein the pilot circuit is disconnected. When the spring 222 is dimensioned to overcome all of the friction forces that go against the backing up of the body 102 in the body 202, until its position of FIG. 7, there is no intermediate position during the coupling. Indeed, as soon as the pin 104 pushes back the safety ring 220, the connector passes, in the case of a successful coupling, exclusively between a position wherein the locking pin 104 is in contact with the safety catch 234 to a coupled position wherein the locking pin 104 is blocked in locked position in the locking notch 238 by the safety catch 234. This is in fact a safety in the event of an incomplete coupling, since the safety catch 234 pushes back the locking pin 104 into a position wherein the pilot circuit is open and therefore wherein no current can pass through the power circuit. The fact that the coupling is incomplete can be detected easily by the operator since the current is not flowing in the power circuit.

The coupling forces are distributed over the coupling course of travel. Indeed, first appears the force of the deformation of the earth contact 208 by the earthing pin 108, then the deformation force of the power contacts 212 by the power pins 112, then the crushing of the seal 224 simultaneously with the fitting force of the pilot pins 114 into the pilot contacts 214 and finally the deformation of the shielding blade 226 and the compression of the air contained inside the bodies 102 and 202. Distributing the resistant forces over the entire coupling course of travel is more ergonomic for the operator during an electrical connection.

After indexing of the two bodies 102 and 202, the single force of axially bringing together the two bodies 102 and 202 allows for the engagement of the locking pin 104 in the locking groove 218 and the locking of the pin 104 in the locking notch 238 with the locking ring 236 which rotates around the axis X3-X3. This is referred to as automatic coupling.

The construction of the connector R with a safety ring 220 blocking the locking pin 104 in locked position in the inclined notch 238 makes it possible to limit the angle $\gamma$233 of angular rotation of the ring 216 required for the locking and therefore to limit the angle of opening $\alpha$218 which is at least equal to the angle $\gamma$233 for a compact connector.

During the uncoupling, the operator pulls the safety ring 220 towards the rear and simultaneously carries out a movement of axially separating two connection elements 100 and 200 in order to drive the locking pins 104 outside of the locking grooves 218. The arrangement of the distances between the pins 108, 112 and 114 and their respective contacts 208, 212, 214 implies that the pins 108, 112 and 114 come out of their contacts 208, 212 and 214 in the reverse order of that described for the coupling. That is to say, the connection of the pilot circuit is broken first, then comes the disconnection of the power circuit then finally the disconnection to the earth. This makes it possible to provide for the safety of the operator during the uncoupling. Likewise, as soon as the locking pins 104 are released by the safety ring 220 and leave the locking notch 238, it is guaranteed that, without any action from the operator, the pins 104 are pushed back by the safety catches 234 towards a position wherein at least the pilot circuit is interrupted and wherein therefore there is no longer any current passing in the power circuit.

Figure 8:
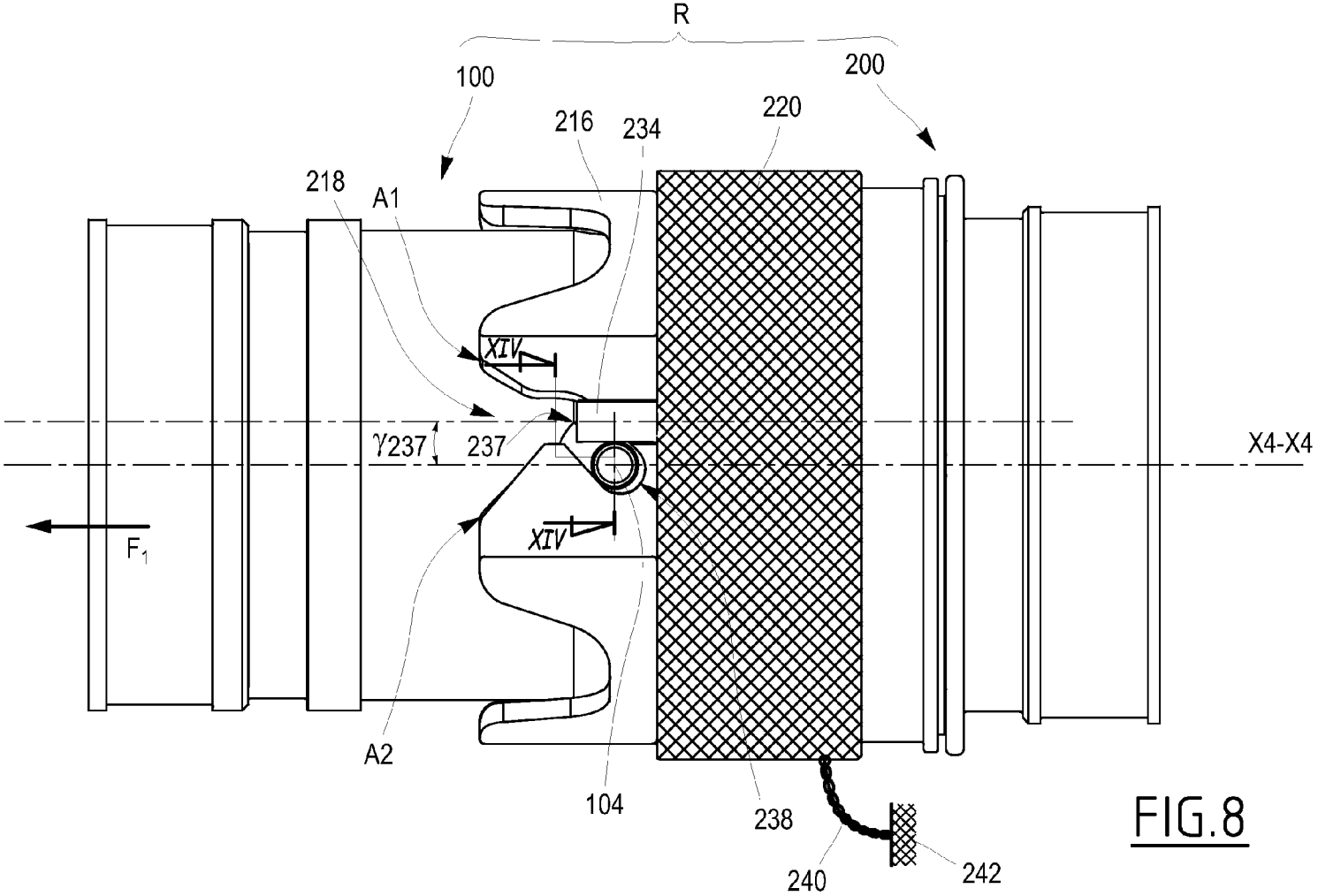
Figure 9:
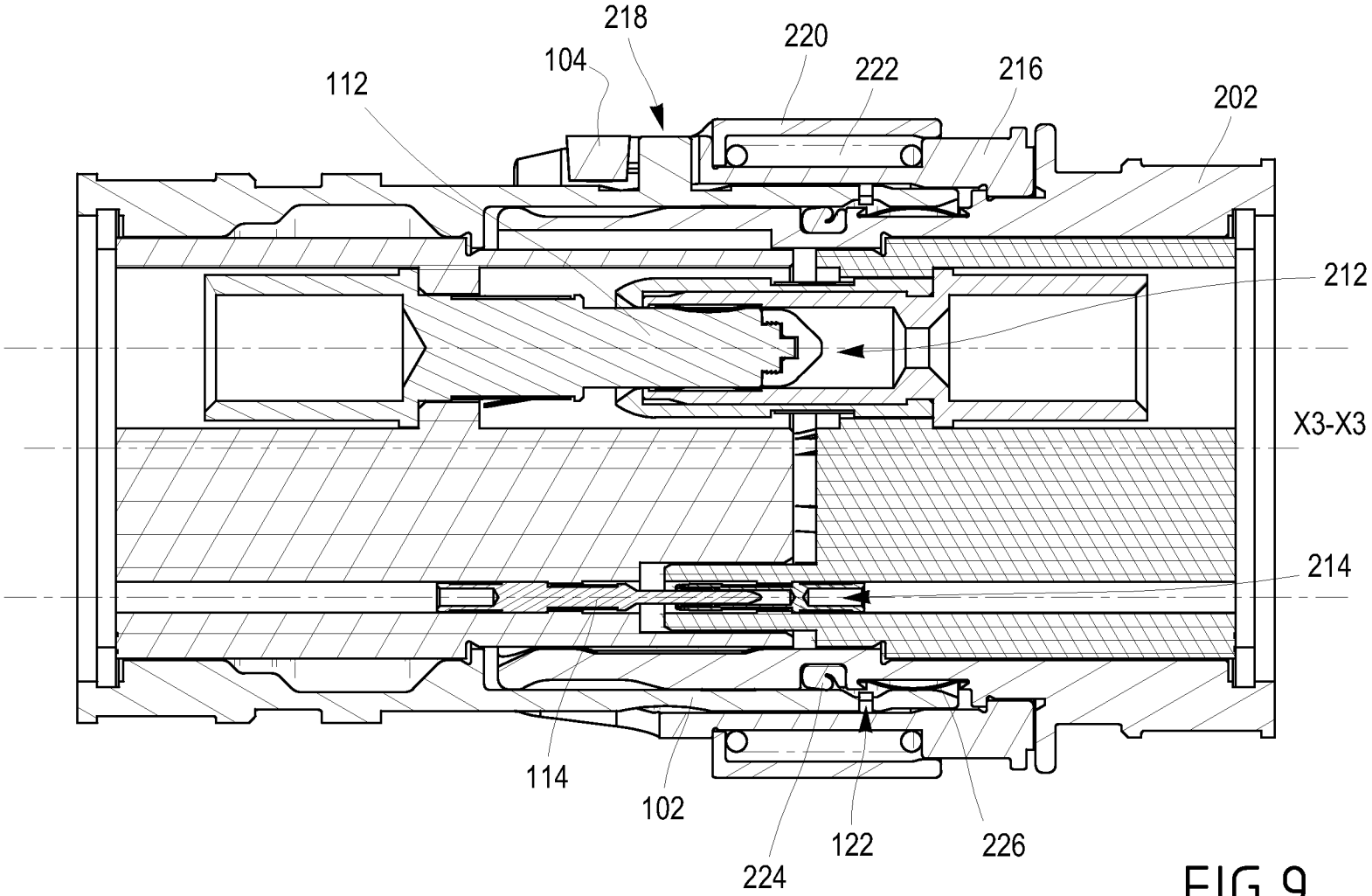

According to an optional aspect of the invention shown only diagrammatically in FIG. 8, an additional safety is provided that is useful in the case of a forced fitting of the elements 100 and 200. Indeed, it is common for the connector R to provide the interface between a fixed frame 242, which is for example a mains terminal, and a mobile portion, which is for example a machine that can move on an assembly line. As such, it is interesting to be able to guarantee an uncoupling of the connector when one of the two elements of the connector moves away from the other in an untimely manner. To this effect, the connection element 200 provided on the fixed frame 242 is provided with means for fastening, such as a chain 240, that connects the safety ring 220 to the fixed frame 242. In this way, the withdrawal movement of the male element 100 in the direction of the arrow F1 in FIG. 8, while the connector is still coupled, drives in its movement of translation, the body 202 of the female element 200 and the locking ring 216. The movement of the safety ring 220 in the same direction is limited by the chain 240. If the movement of the element 100 continues in the direction of the arrow F1, the safety ring 220 backs up in relation to the locking ring 216 and the safety catches 234 move away from the passage between the locking notch 238 and the zone 237, as such releasing the pins 104. The latter are no longer blocked in the notches 238, they exit the grooves 218 and the connector R is uncoupled.

According to an alternative not shown of the invention, the seal 224 and/or the blade 226 can be provided on the male element 100.

According to another alternative, certain pins among the pins 108, 112 and 114 can be provided on the female element 200.

According to another alternative, the chamfer is slightly curved.

According to another alternative, the safety ring is provided with a single safety catch cooperating with one of the multiple locking grooves of the connector.

According to another alternative, the mechanical foolproof device formed by 210/116 can be arranged around other respective pins and contacts.

Alternatively, the number of grooves 120 and 215 can be different from four.

According to another alternative, the safety ring 220 is not pressing against a spring but the safety catch 234 is elastically deformable. The deformation of this catch 234 makes it possible to clear the passage of the pin 104 and the elastic return makes it possible to lock the pin 104 in the notch 238.

Alternatively, the slope of the surface 2362 may not be inclined in relation to the axis X2-X2, giving rise to a dissymmetric outlet. Finally, the angle of inclination of at least one of the slopes of the surfaces 2362 and 2364 is between 20 and 60°.

The invention claimed is:

1. Electrical connector, comprising a first connection element and a second connection element, complementary to the first connection element, the two connection elements being able to be coupled to one another according to a coupling axis, the first and the second connection element comprising:

at least one pin carried by the first element or the second element and at least one respective contact carried by the second element or the first element, a bayonet-type locking mechanism of the connector comprising at least one locking pin arranged on a body of the first connection element and at least one locking ring mounted rotatingly around a body of the second connection element and comprising a locking groove with an outlet and a locking notch wherein the locking pin is able to be locked axially in relation to the body of the second connection element.

means for indexing, making it possible to position the body of the first element and the body of the second connection element, one in relation to the other around the coupling axis in an indexed configuration which intervenes, during coupling, before the engagement of the locking pin in the locking groove, wherein the second connection element comprises a safety ring mounted mobile in axial translation in relation to the locking ring, and comprising at least one safety catch, the safety ring is able to be pushed back by the locking pin during coupling between, a first position wherein the safety catch blocks the passage of the pin between the locking notch and the outlet, and a second position wherein the safety catch authorises the passage of the pin, the safety ring being drawn back elastically to its first position, each locking groove comprises at the front, a chamfer delimiting said outlet, and the rotation range of the locking ring in relation to the body of the second connection element around the coupling axis is limited, and in the indexed configuration of the bodies and of the first and second elements, the axis of travel of the pin intersects said outlet of the locking groove over the entire rotation range of the locking ring.

2. Electrical connector according to claim 1, wherein the angle of opening of the outlet of the locking groove in a plane perpendicular to the axis is greater than or equal to the rotation range of the locking ring around the body of the second connection element.

3. Electrical connector according to claim 1, wherein the locking notch is inclined in relation to the coupling axis by moving away from the front of the locking ring and in that the safety catch blocks the locking pin in locked position in coupled configuration of the connector.

4. Electrical connector according to claim 1, wherein the first and the second connection element further include means for earthing including an earthing pin arranged on an element among the first and the second connection element and an earth contact arranged on the other element, with the earthing pin able to engage according to the coupling axis into the earth contact, means for connecting a power circuit including at least one power pin arranged on an element among the first and the second connection element and at least one power contact arranged on the other element, the power pin able to engage, according to the coupling axis, into the power contact.

means for connecting a pilot circuit including at least one pilot pin arranged on an element among the first and the second connection element and at least one pilot contact arranged on the other element, with the pilot pin able to engage, according to the coupling axis, into the pilot contact.

5. Electrical connector according to claim 4, wherein, in said indexed configuration of the two bodies before the engagement of the pin with the locking groove, an axial distance, taken according to an axis parallel to the coupling axis, between each earthing pin and its respective earth contact is less than an axial distance between each power pin and its respective power contact, said axial distance between each power pin and its respective power contact being less than an axial distance between each pilot pin and its respective pilot contact.

6. Electrical connector according to claim 4, wherein, during coupling, the connection to the earth is carried out before the connection of the power circuit, said power connection being carried out before the connection of the pilot circuit.

7. Electrical connector according to claim 5, wherein the first connection element and/or the second connection element further comprises a seal able to cooperate with the body of the second connection element and the body of the first connection element and wherein the seal seals the inside of the bodies of the first and second elements during the coupling after the power circuit has been connected.

8. Electrical connector according to claim 5, wherein the second connection element comprises, a shielding blade arranged on a body among the body of the first connection element and the body of the second connection element and able to cooperate with the other body among the body of the first connection element and the body of the second connection element after the power circuit has been connected.

9. Electrical connector according to claim 4, wherein, during the coupling, when the locking pin comes into contact with a safety catch of the safety ring arranged in its first position, the connection of the or of each pilot pin in the respective pilot contact is not effective.

10. Electrical connector according to claim 4, wherein, when the pin cooperates axially with the safety ring while the safety ring is between its first and its second position, the safety ring is able to automatically push back, and without action from the operator, a locking pin towards a position wherein the connection of the or of each pilot pin in the respective pilot contact is not effective.

11. Electrical connector according to claim 1 wherein the body of the first connection element and/or the body of the second connection element is formed of an external body and of an internal insulating body and in that the internal insulating body is able to be immobilised in relation to the external body in several configurations angularly offset in relation to a central axis of the connection element.

12. Electrical connector according to claim 1, wherein the first connection element and/or the second connection element further include a mechanical foolproof device, comprised of a bore formed around a pin, the diameter of the bore being substantially equal to the diameter of a cylindrical finger arranged around the respective contact, in that during the coupling, the bore and the finger are offset radially in relation to the coupling axis and in that the bore and the finger are able to cooperate in indexed configuration of the bodies.

13. Electrical connector according to claim 1, wherein the rotation range of the locking ring in relation to the body of the second connection element around the axis, is limited angularly by a blocking member.

14. Electrical connector according to claim 13, wherein the blocking member is a key housed in the body of the second connection element, or respectively in the locking ring, and cooperating on the rotation range with a housing radially aligned with the key and arranged in the locking ring, or respectively in the body of the second connection element.

15. Electrical connector according to claim 1 wherein the second connection element comprises means of fastening the safety ring to a fixed point outside of the connector.

* * * * *